United States Patent [19]

Desjardins

[11] Patent Number: 4,969,617

[45] Date of Patent: Nov. 13, 1990

[54] PAINTER'S TOOL

[76] Inventor: Warren Desjardins, 18 Bonita Rd., East Quogue, N.Y. 11942

[21] Appl. No.: 443,006

[22] Filed: Nov. 29, 1989

Related U.S. Application Data

[63] Continuation-in-part of Ser. No. 258,010, Oct. 14, 1988, Pat. No. 4,890,807.

[51] Int. Cl.[5] ..... A47G 23/02

[52] U.S. Cl. ..... 248/146; 220/220; 248/110

[58] Field of Search ..... 248/146, 110, 111, 112, 248/113, 210; 220/20, 69, 70, 90; 211/65, 66

[56] References Cited

U.S. PATENT DOCUMENTS

| | | | |
|---|---|---|---|
| 2,625,299 | 1/1953 | Uhlig | 248/110 X |
| 3,329,307 | 7/1967 | Jacobson | 220/90 |
| 3,510,023 | 5/1970 | Ullman et al. | 220/90 X |
| 3,671,992 | 6/1972 | Linger | 220/90 X |
| 4,009,802 | 3/1977 | Hayduchok | 220/90 X |
| 4,225,064 | 9/1980 | Westcott | 220/90 X |
| 4,247,013 | 1/1981 | O'Hori | 220/90 |
| 4,266,686 | 5/1981 | Carter | 220/90 |
| 4,782,970 | 11/1988 | Edwards | 220/90 X |
| 4,844,281 | 7/1989 | Bradford | 220/90 |
| 4,865,282 | 9/1989 | Yonkman et al. | 220/90 X |
| 4,890,807 | 1/1990 | Desjardins | 248/146 |

FOREIGN PATENT DOCUMENTS

| | | | |
|---|---|---|---|
| 2213459 | 8/1989 | United Kingdom | 220/90 |

*Primary Examiner*—Ramon O. Ramirez
*Attorney, Agent, or Firm*—Richard L. Miller

[57] ABSTRACT

A multiple-use painter's tool comprises a semicircular plastic attachment which fits securely over the top rim of an open paint can. The tool has a flat shelf segment with a serrated edge useful for supporting or cleaning excess paint from a brush. A slit in the shelf is useful for cleaning a stirring stick. Attached to the outside of the tool is a painting tool holder and a scraping edge.

6 Claims, 1 Drawing Sheet

PAINTER'S TOOL

This application is a continuation in part of a copending application Ser. No. 07/258,010, filed Oct. 14, 1988, now U.S. Pat. No. 4,890,807 entitled LIQUID TOOL CADDY, for which a continuous chain of copendency has been maintained.

BACKGROUND OF THE INVENTION

1. Field of the Invention

This invention relates to a multiple-use painter's tool comprising a plastic attachment which fits securely over the top rim of an open paint can and is adapted for holding and cleaning painting tools, and also has a scraping edge useful in numerous applications.

2. Description of the Prior art

Holders for painting implements which are supported by a paint container are well known in the art. For example, U.S. Pat. No. 4,266,686 to Carter, shows a holder for paint brushes mounted on the rim of an open paint can. U.S. Pat. No. 4,436,217 to Ritter, shows a paint brush support attached to the outside of a paint can. Both of these prior art patents make references to, and have cited, a large number of prior art references. None of the references, however, show the inventive features of the present invention.

SUMMARY OF THE INVENTION

The present invention comprises a one piece plastic painter's tool having a substantially semicircular rim portion with a channel along its entire length adapted to fit snugly over the top rim of an open paint can. Attached on the inside of the rim portion and extending therefrom a short distance is a flat shelf segment terminating in an edge having a plurality of serrations. A narrow rectangular slit bounded on three sides extends into the shelf segment adjacent one end thereof. The shelf segment is useful for supporting a paint brush when the brush is laid horizontally between the shelf portion and the rim of the paint can. The serrations are useful for cleaning or removing excess paint from a brush as the brush is removed from the paint can. The slit is useful to clean a paint stir stick which may be passed through the slit upon removal from the paint can.

Extending horizontally from the outside of the semicircular rim portion and integral therewith is a looped extension which defines an opening adapted to support therein a tool such as a putty knife or a screwdriver. Also integral with and extending horizontally from the outside rim of the semicircular rim portion is a scraper edge useful for scraping or cleaning prior to painting.

A unique feature of this invention is the inclusion of a plurality no flanged shoulders located on the inside of the channel in the semicircular rim portion of the painter's tool and which engage the outside of the paint can immediately below the rim and hold the rim and hold the tool firmly on the top of the paint can. A plurality of slits are located on the top of the channel in the semicircular rim portion immediately above the flanged shoulders, permitting the painter's tool to flex slightly so that the painter's tool will snap onto and remain firmly affixed to the paint can.

An object of the present invention is a painter's tool which fits on the top of an open paint can and has a shelf with a serrated edge useful to provide support to a paint brush laid on the top of the paint can, and also has a serrated edge useful to remove excess paint from paint brushes.

A further object of the present invention is a painter's tool which fits on the top of a paint can and contains a narrow slit bounded on three sides and useful for removing excess paint from a stir stick or painting tool.

A still further object of the present invention is a painter's tool which fits on the top of a paint can and has integral therewith and extending outward from the semicircular rim portion a looped extension defining an opening useful for holding a painting tool, and also has extending from the outside of the rim portion a scraper edge useful for scraping or cleaning prior to painting.

Another object of this invention is a painter's tool comprising a semicircular rim portion having a channel adapted to fit snugly over the rim of an open paint can, and a plurality of flanged shoulders extending inwardly from the outside of the channel which fit beneath the rim of the paint can on the outside thereof and to hold the device securely to the paint can, the top of the channel also containing a plurality of slits adjacent to the flanged shoulders, the slits adding flexibility to the painter's tool permitting it to be flexed and snapped over the flanged rim of a paint can.

BRIEF DESCRIPTION OF THE DRAWING FIGURES

The FIGURES in the drawings are briefly described as follows.

DESCRIPTION OF THE PREFERRED EMBODIMENT

Figure 1:
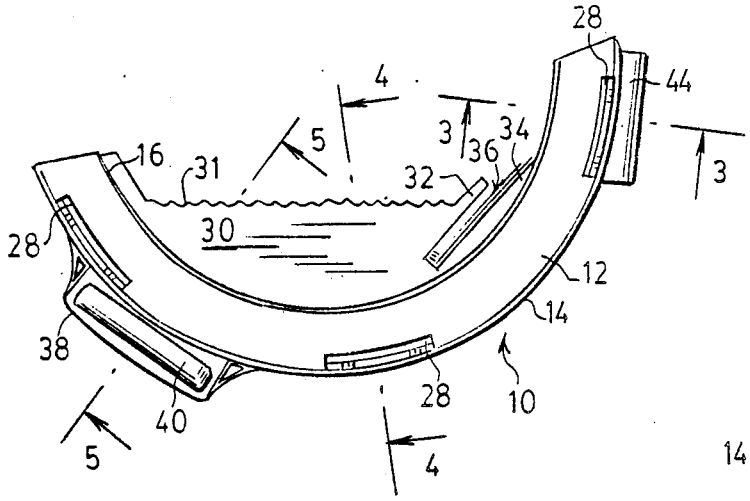
FIG. 1 is a top view of the present invention.
Figure 3:
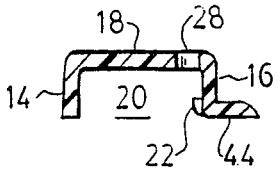
FIG. 3 is a cross-sectional view taken along line 3—3 of FIG. 1.
Figure 4:
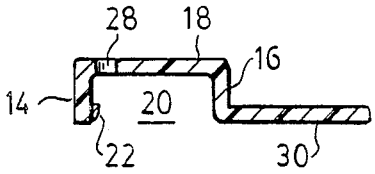
FIG. 4 is a cross-sectional view taken along line 4—4 of FIG. 1.
Figure 2:
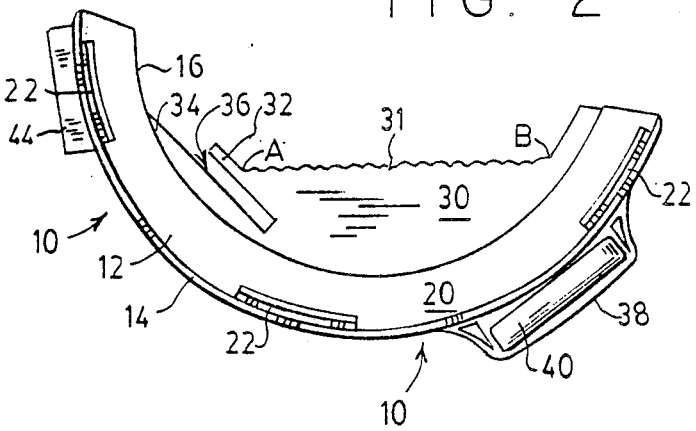
FIG. 2 is a bottom view of the present invention.
Figure 5:
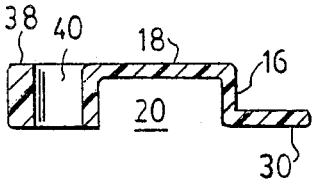
FIG. 5 is a cross-sectional view taken along line 5—5 of FIG. 1.

Referring to FIGS. 1 and 2, reference numerical 10 shows the painter's tool which is manufactured preferably from a plastic material in one piece such as by a molding process. The plastic is preferably sufficiently thick or strong so that the tool is substantially rigid, but with the addition of slits (as will be described) having some "give" upon the application of twisting or flexing forces to the ends thereof.

The painter's tool 10 has a semicircular rim portion 12 which fits securely over the top rim of an open paint can. The most useful size of the painter's tool is such as to fit on a one gallon paint can, but other sizes are clearly within the scope of this invention.

Figure 6:
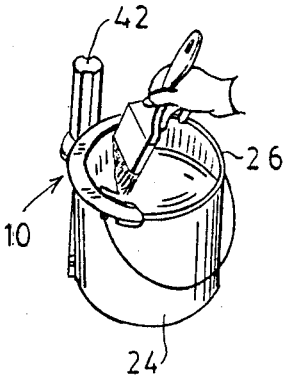
FIGS. 6, 7, 8 and 9 are perspective views illustrating various uses of the present invention.
Figure 7:
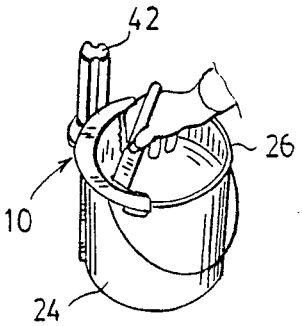
Figure 8:
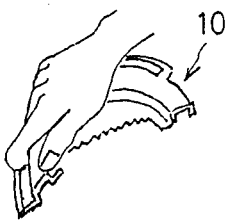
Figure 9:
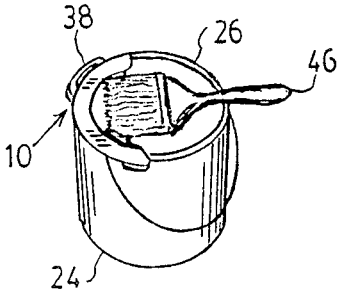

Rim portion 12 comprises an outside wall 14, an inside wall 16 and a top wall 18 defining a three-sided channel 20. Extending from the bottom of the inside of outside wall 14 is a plurality of flanged shoulders 22 spaced substantially equal about the semicircular rim portion. Three such shoulders are considered optimum for the one gallon size of paint can, but other numbers may be used. The flanged shoulders 22 hold the painter's tool 10 securely on the top of a paint can 24 as shown in FIGS. 6, 7 and 9. The shoulders 22 press against the side of the paint can 24 beneath the flanged rim 26. Channel 20 is sized to fit snugly over the rim 26 of the paint can.

A unique feature of the present invention is a plurality of narrow slits 28 which are located in top wall 18 adjacent to the portion of outside wall 14 directly above the flanged shoulders 22, the slits extending circumferentially substantially the same number of degrees of arc as the flanged shoulders 22, although other locations and/or shapes may be used. The important feature is that the painter's tool 10 have flexibility immediately adjacent to the two flanged shoulders 22 near the opposite ends of the semicircular rim portion 12. It has been found that without slits 28 or some other similar arrangement, it is difficult to snap over the rim 26 of the paint can 24 a painter's tool having sufficient rigidity to be useful. With the addition of slits 28, device 10 becomes more flexible, especially with respect to twisting moments about the exterior ends of the device 10, and with the slits 28 the device 10 becomes significantly easier to fit on and take off over the top rim of a paint can.

Extending inwardly toward the opposite side of the circle from the bottom of inner wall 16 is a flat shelf 30 which approximates in shape a segment of a circle bounded by the arc formed by the inside of semicircular rim portion 12 and a chord extending between points A and B and so labelled in FIG. 2. The edge of the shelf 30 along the chord is serrated as shown by reference numerical 31, which makes it useful as a scraping edge for removing excess paint from a paint brush or the like as shown in FIG. 6. At one side of the shelf 30 in the vicinity where it meets inner wall 16 a projection 32 extends beyond the chord and forms, together with a narrow segment shaped extension 34 of shelf 30, a narrow rectangular slit 36 bounded on three sides. Slit 36 is useful for scraping excess paint from a stir stick as it is removed from paint can 24, as shown FIG. 7.

Formed as part of the painter's tool 10 and extending horizontally from the outside of outer wall 14 is a looped extension 38 defining a hollow, substantially rectangular opening 40 which is useful for holding a tool 42 such as a screwdriver or putty knife as shown in FIGS. 6 and 7. The opening 40 may also be useful to hang the device 10 on a nail, hook, etc when storing. Also integral with and extending horizontally from outside wall 14 is a scraper edge 44 useful for removing peeling paint or cleaning surfaces, preferably before painting.

As shown in FIG. 9, shelf 30 may be used as a rest for a brush 46 in conjunction with rim 26 so that excess paint from the brush will drip in rather then out of the can.

The serrated edge 31 and slit 36 are also useful for cleaning a putty knife or other tool, and the serrated edge 31 is also useful for both bristle and synthetic paint brushes. At the end of painting, much of the clean-up can be done using the painter's tool 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A painter's tool formed of one piece of a homogeneous, relatively rigid material and comprising:

(a) a rim portion which is substantially semicircular and has a channel therein extending the entire arc of said rim portion and sized such as to fit closely over the top rim of an open paint can;

(b) a plurality of flange means connected with said channel for securing said rim portion to the top of said paint can;

(c) a flat shelf extending toward the center of the circle bounded by said rim portion and having a portion thereof approximately a geometric segment defined by the inside of said rim portion and by a chord extending between two points on said rim portion, the shelf portion terminating in a serrated edge along said chord, said shelf also having a narrow slit therein forming three sides of a rectangle and open immediately adjacent the serrated edge of said shelf; and (d) a narrow horizontal wedge portion extending horizontally from the outside of said rim portion a short distance and having thin scraping edge along the outside thereof.

2. A painter's tool as in claim 1 in which both ends of a shelf immediately adjacent said rim portion extend a short distance beyond said chord, and in which said slit is formed at one side of said shelf with the slit being formed in one of the extended ends of said shelf in which the inside of an extended end of said shelf which is opposite that containing said slit forms, together with said serrated edge, first and second scraping edges for removing paint from a paint brush.

3. A painter's tool as in claim 1 in which a plurality of projections comprise three such projections, one of which is near each end of said rim portion and the other of which is intermediate said ends.

4. A painter's tool as in claim 1 and further including a loop extending horizontally from the outside of said rim portion a short distance and defining a substantially rectangular opening therein.

5. A painter's tool as in claim 1 in which said rim portion includes an inside wall, an outside wall and a top wall, said walls defining said channel, and in which said flange means comprises a plurality of narrow, flanged shoulders extending a short distance from the inside of said outside wall parallel to said top wall, each of said plurality of shoulders extending over a small sector of arc and spaced apart along said outside wall.

6. A painter's tool as in claim 1 and including a plurality of narrow rectangular slits in said top wall, each of which is coplanar with and coextensive with each of said plurality of flanged projections, said slits permitting flexibility of said tool and ease of application to the top of an open paint can when a twisting moment is applied to one or both ends of said rim portion.

* * * * *